US008205274B2

(12) United States Patent
Lin et al.

(10) Patent No.: US 8,205,274 B2
(45) Date of Patent: Jun. 26, 2012

(54) LIFT AND CLEAN TOILET SEAT HINGE

(75) Inventors: Shan Lin, Fujian (CN); Yanxin Xu, Fujian (CN)

(73) Assignee: WDI International, Inc., Irvine, CA (US)

( * ) Notice: Subject to any disclaimer, the term of this patent is extended or adjusted under 35 U.S.C. 154(b) by 1095 days.

(21) Appl. No.: 11/933,963

(22) Filed: Nov. 1, 2007

(65) Prior Publication Data

US 2009/0113610 A1 May 7, 2009

(51) Int. Cl.
*A47K 13/12* (2006.01)

(52) U.S. Cl. ..... 4/240; 4/236; 16/252

(58) Field of Classification Search ..... 4/236–240, 4/254, 667; 16/252–255, 257–258, 250; 251/257; 411/517, 519, 532–533, 544
See application file for complete search history.

(56) References Cited

U.S. PATENT DOCUMENTS

| | | | | |
|---|---|---|---|---|
| 2,658,248 | A * | 11/1953 | Kost | 411/522 |
| 3,055,015 | A | 9/1962 | Silverman | |
| 3,308,483 | A * | 3/1967 | Miller | 4/236 |
| 4,326,307 | A | 4/1982 | Baillie et al. | |
| 5,267,357 | A | 12/1993 | Ades | |
| 5,303,429 | A | 4/1994 | Nötzold | |
| 5,396,663 | A | 3/1995 | Burgess | |
| 5,414,875 | A | 5/1995 | Kappl et al. | |
| 5,515,552 | A | 5/1996 | Tolsma | |
| 5,933,875 | A | 8/1999 | Hulsebus et al. | |
| 6,070,295 | A | 6/2000 | Hulsebus | |
| 6,101,640 | A | 8/2000 | Brewer et al. | |
| 6,263,516 | B1 * | 7/2001 | Pedersen et al. | 4/236 |
| 6,381,762 | B1 | 5/2002 | Moser | |
| 6,643,851 | B1 | 11/2003 | Janes | |
| 6,763,529 | B1 | 7/2004 | Richter | |
| 6,807,686 | B1 | 10/2004 | Janes | |
| 7,155,748 | B2 | 1/2007 | Vierkant, III et al. | |
| 7,203,975 | B2 | 4/2007 | Vierkant, III | |
| 7,744,324 | B2 * | 6/2010 | Bassani et al. | 411/546 |
| 7,827,626 | B2 * | 11/2010 | Zhou | 4/236 |
| 2004/0234358 | A1 * | 11/2004 | Genick | 411/533 |
| 2005/0220567 | A1 * | 10/2005 | Winker | 411/533 |

* cited by examiner

*Primary Examiner* — Winnie Yip
(74) *Attorney, Agent, or Firm* — Walter A. Hackler

(57) ABSTRACT

A toilet featuring a lift and clean toilet seat hinge includes a toilet bowl, toilet seat, and the hinge includes a hinge base, a post, and a flap for closing the hinge base. The mounting post is provided with an expandable head and the flap includes a ring for expanding the head in order to releasably lock the mounting post to the toilet seat hinge base.

12 Claims, 2 Drawing Sheets

LIFT AND CLEAN TOILET SEAT HINGE

The present invention is generally related to a toilet, toilet seat, and a toilet seat hinge for detachably securing the toilet seat to the toilet bowl. More particularly, the present invention is directed to a toilet seat hinge which facilitates ready removal of the seat from the toilet bowl when, for example, it is desired to clean the toilet bowl or toilet seat, and/or replace the toilet seat. As hereinabove noted, it is frequently desirable to remove a toilet seat from its associated toilet bowl for cleaning or replacement. Typically, this is a difficult task since most seats are secured by threaded fasteners.

Over time, particularly in the humid environments associated with bathrooms, the threaded fasteners are prone to both becoming soiled and frozen by corrosion. In addition, such toilets are usually not provided with generous space so that access to these fasteners is cramped.

The present invention provides for an improved lift and clean toilet seat hinge for providing secure fastening of a toilet seat to a toilet bowl as well as being aesthetically pleasing.

SUMMARY OF THE INVENTION

A lift and clean toilet seat hinge in accordance with the present invention generally includes a mounting post having a shank for extending through a toilet bowl and an expandable head along with a toilet seat hinge base having an opening therethrough for receiving the expandable head.

A flap is provided for closing the hinge base opening and expanding the expandable head within the hinge base opening in order to releasably lock the mounting post to the toilet seat hinge base.

More particularly, the post shank may be threaded and the hinge may further comprise a nut with the nut being threaded onto the threaded shank in order to secure the mounting post to the toilet bowl.

Preferably, the expandable head includes a perforated, or segmented, ring and the hinge base opening includes a circumferential shelf for underlying the perforated ring when expanded by the flap. In that regard, the flap preferably includes a depending ring for expanding the perforating ring with the flap being pivotably hinged to the hinge base. In addition, the perforated ring may include teeth for engaging the hinge base opening.

In combination, the present invention provides for a toilet seat assembly which includes a toilet seat, a toilet seat lid and a hinge interconnecting the toilet seat and the toilet seat hinge. The hinge includes the hereinabove recited elements.

The invention further encompasses the toilet which includes a toilet bowl, a seat, and a hinge interconnecting the toilet bowl and the toilet seat with the hinge including the elements hereinabove recited.

BRIEF DESCRIPTION OF THE DRAWINGS

The present invention may be more clearly appreciated when taken in conjunction with the accompanying drawings, in which.

DETAILED DESCRIPTION

Figure 1:
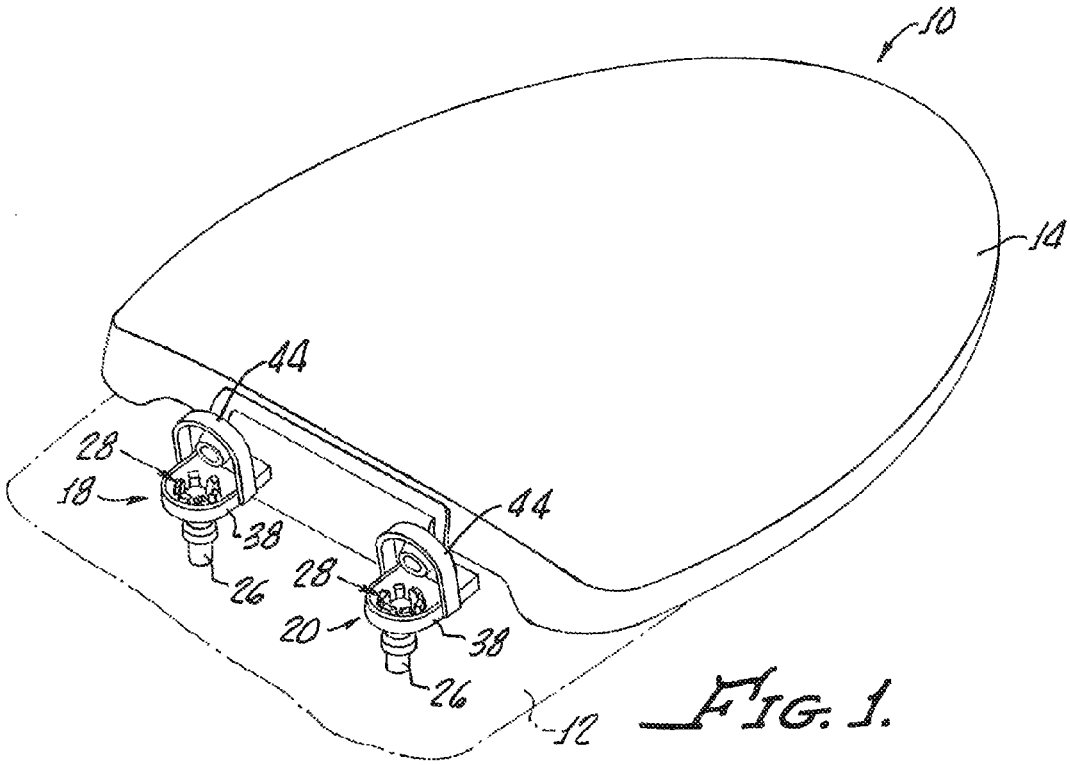
FIG. 1 is a perspective view of a toilet seat bowl, toilet seat, and a hinge generally showing a mounting post, a toilet seat hinge base along with a flap for closing a hinge base opening.
Figure 2:
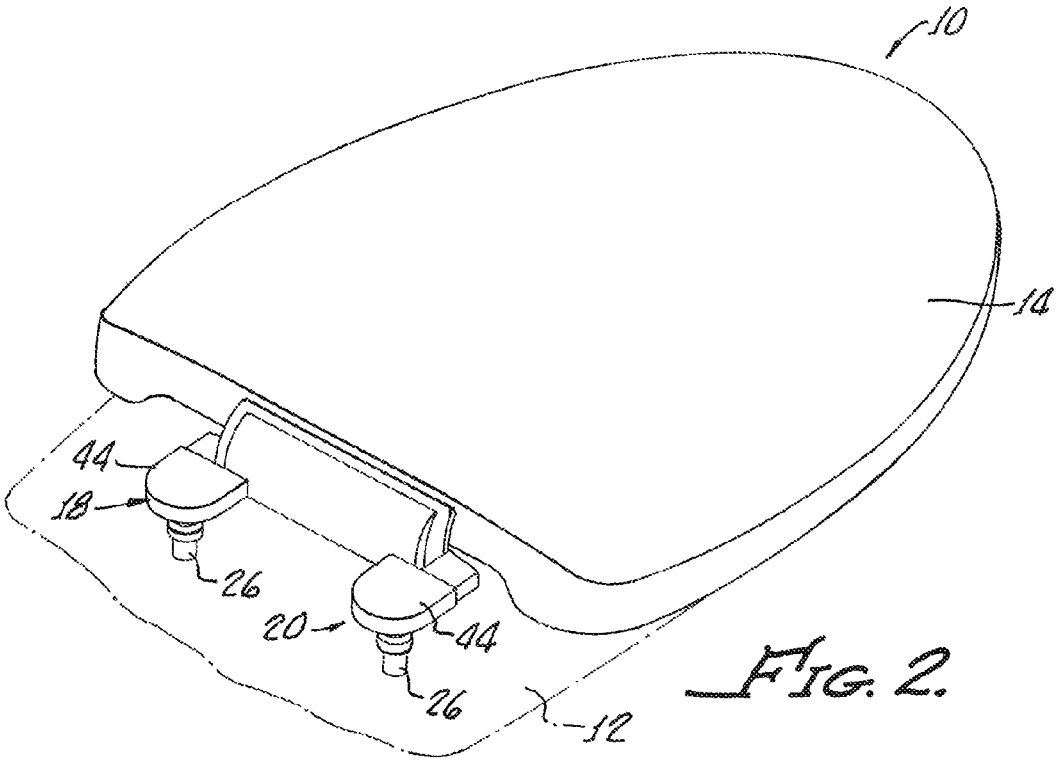
FIG. 2 is a perspective view similar to that shown in FIG. 1 showing the flap closed.

With reference to FIGS. 1 and 2, there is shown a toilet 10 in accordance with the present invention showing, in combination, a toilet bowl 12, which may be of conventional design, along with a toilet seat 14 and hinges 18, 20 for interconnecting the toilet bowl 12 and the toilet seat 14.

Figure 3:
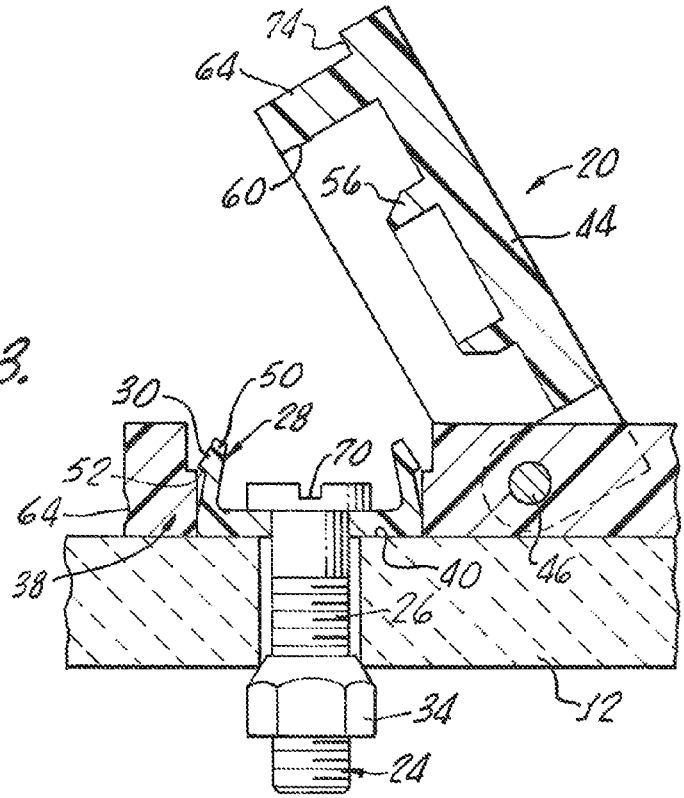
FIG. 3 is an exploded cross sectional view of the hinge shown in FIGS. 1 and 2 more clearly illustrating the post having an expandable head and the flap including a depending ring for expansion of the expandable head to secure the hinge base to the mounting post head.
Figure 4:
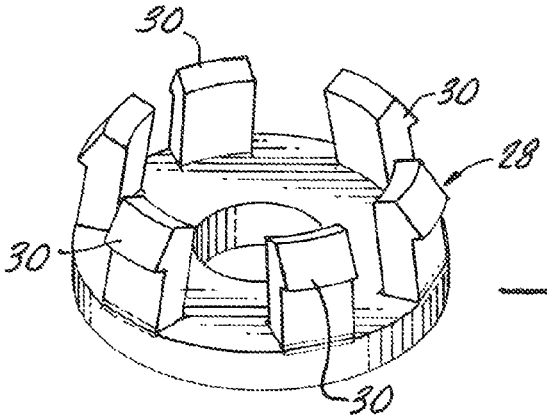
FIG. 4 is a perspective view of the post expandable head showing a perforated or segmented, structure.

As most clearly shown in FIG. 3, the hinge 20 includes a mounting post 24 having a shank 26 for extending through the toilet bowl 12 and an expandable head 28 which is preferably perforated with a plurality of arcuate segments, or sections, as illustrated in FIG. 4. A nut 34 may be utilized and threaded onto the shank 26 in order to secure the post 24 to the toilet bowl 12 in a conventional manner.

Each of the hinges 18, 20 include a hinge base 38, common reference characters associated with the components of the hinges 18, 20 having like character reference in the FIGS. 1 and 2.

With reference again to FIG. 3, the hinge base 38 includes an opening 40 therethrough for receiving the expandable head 28.

Figure 5:
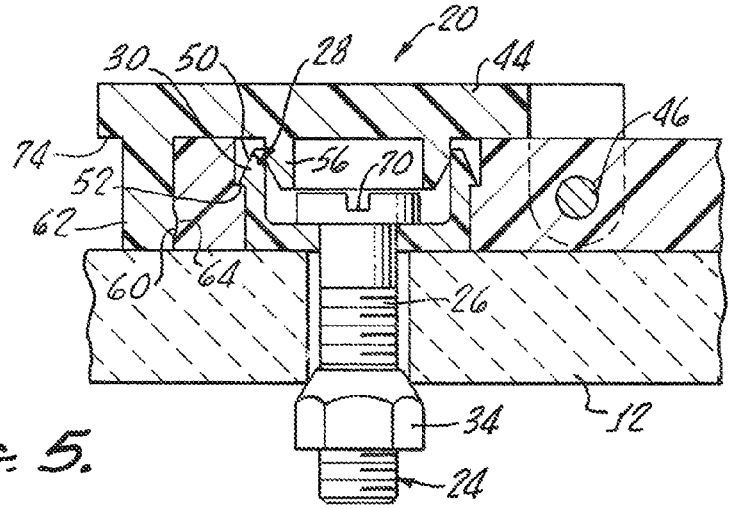
FIG. 5 is a cross sectional view corresponding to FIG. 3 showing the flap closed with the depending ring expanding the expandable head to secure the hinge base to the mounting post and toilet bowl.

A flap 44 is attached to the hinge base 38 by a pivot 46 enabling the flap 44 to close over the hinge base opening 40 and expand the expandable head 28 within the hinge base opening 40 in order to releasably lock the mounting post head 28 and mounting post 24 to the toilet seat hinge base 38 as illustrated in FIG. 5.

The perforated head 28 segments 30 preferably include teeth 50 for engaging the hinge base opening 40 which may also include a circumferential shelf 52 for enhancing the coupling, or locking of the head 28 to the hinge base 38.

Expansion of the head 28 is caused by a ring 56 depending from the flap 44 as illustrated in FIG. 5. When closed the hinge 18, 20 has an aesthetically pleasing appearance as illustrated in FIG. 2.

A protrusion 60 on a flap leg 64 and a detent 64 in the hinge base 38 further couples the flap 44 in a closed position over the hinge base 38 in a closed position.

The shank 26 may include a screw driver slot 70 facilitating installation of the post 24 to the toilet bowl 12 and a finger ledge 74 on the flap 44 may be provided to facilitate finger opening of the flap by pivoting with respect to the base 38 to remove the ring 56 from the head 28 thus enabling a perforated head 28 to collapse so that the toilet seat 14 may be easily removed from the toilet bowl 12.

Although there has been hereinabove described a specific toilet, toilet seat and lift and clean toilet seat hinge in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A lift and clean toilet seat hinge comprising:

A hinge base having an opening therethrough, said opening including a circumferential shelf;

a mounting post having a large head, and a shank extendable through a toilet bowl;

a separate expandable head receiveably by the hinge base opening and secured to the hinge base by the mounting post; and a flap for closing the hinge base opening and expanding said expandable head within the hinge base opening in order to releasably lock said mounting post to said toilet seat hinge base;

wherein said expandable head comprises a perforated ring including teeth, said hinge base opening includes a circumferential shelf to be engaged by said teeth when the perforated ring expanded by the flap.

2. The hinge according to claim 1 wherein the post shank is threaded and the hinge further comprises a nut, the nut being threaded onto the threaded shank in order to secure said mounting post to said toilet bowl.

3. The hinge according to claim 1 wherein said flap includes a depending ring for expanding said perforated ring.

4. The hinge according to claim 3 wherein said flap is pivotably to hinge base.

5. A toilet seat assembly comprising:

a toilet seat;

a toilet seat lid; and a hinge interconnecting said toilet seat and said toilet seat lid, said hinge comprising:

a hinge base having an opening therethrough, said opening including a circumferential shelf;

a mounting post having a large head and a shank extendable through a toilet bowl;

a separate expandable head receivable by the hinge opening and secured to the hinge base by the mounting post; and a flap for closing the hinge base opening and expanding said expandable head within the hinge base opening in order to releasably lock said mounting post to said toilet seat hinge base;

wherein said expandable head comprises a perforated ring including teeth, said hinge base opening includes a circumferential shelf to be engaged by said teeth when the perforated ring expanded by the flap.

6. The seat assembly according to claim 5 wherein the post shank is threaded and the hinge further comprises a nut, the nut being threaded onto the threaded shank in order to secure said mounting post to said toilet bowl.

7. The seat assembly according to claim 5 wherein said flap includes a depending ring for expanding said perforated ring.

8. The seat assembly according to claim 7 wherein said flap is pivotably attached to said hinge base.

9. A toilet comprising:

a toilet bowl;

a toilet seat; and a hinge interconnecting said toilet bowl and said toilet seat; said hinge comprising:

a hinge base having an opening therethrough, said opening including a circumferential shelf;

a mounting post having a large head and a shank extendable through the toilet bowl;

a separate expandable head receivable by the hinge opening and secured to the hinge base by the mounting post; and a flap for closing the hinge base opening and expanding said expandable head within file hinge base opening in order to releasably lock said mounting post to said toilet seat hinge base; and wherein said expandable head comprises a perforated ring including teeth, said hinge base opening includes a circumferential shelf to be engaged by said teeth when the perforated ring expanded by the flap.

10. The toilet according to claim 9 wherein the post shank is threaded and the hinge further comprises a nut, the nut being threaded onto the threaded shank in order to secure said mounting post to said toilet bowl.

11. The toilet according to claim 9 wherein said flap includes a depending ring for expanding said perforated ring.

12. The toilet according to claim 11 wherein said flap is pivotally attached to said hinge base.

* * * * *